United States Patent [19]

Tuttle et al.

[11] 3,936,124

[45] Feb. 3, 1976

[54] WATERPROOF CONNECTOR

[76] Inventors: John D. Tuttle, 198 Rivo Alto Canal, Long Beach, Calif. 90803; Delbert J. Wagner, 7333 Jackson St., Paramount, Calif. 90723

[22] Filed: Nov. 1, 1974

[21] Appl. No.: 520,158

[52] U.S. Cl. ..... 339/60 M; 339/61 M; 339/94 M

[51] Int. Cl.² ..... H01R 11/02

[58] Field of Search ... 339/60 R, 60 C, 60 M, 61 R, 339/61 M, 94 R, 94 A, 94 C, 94 M

[56] References Cited

UNITED STATES PATENTS

| | | | |
|---|---|---|---|
| 2,619,515 | 11/1952 | Doane | 339/94 R |
| 2,677,115 | 4/1954 | Stevens | 339/60 M |
| 3,404,363 | 10/1968 | Fischer | 339/94 M |
| 3,816,641 | 6/1974 | Iversen | 339/94 R |

*Primary Examiner*—Roy Lake
*Assistant Examiner*—Mark S. Bicks
*Attorney, Agent, or Firm*—Ralph B. Pastoriza

[57] ABSTRACT

A waterproof connector includes a plug body with conductive blades connected internally to wires extending from an opposite portion of the plug body and a socket body having a channel in its front face. An electrical contact supporting member is arranged to fill the channel in the insulative socket body in such a manner as to define slits between opposite walls of the channel and opposite outside walls of the member. By providing electrical contacts on the opposite outside walls of the member, the plug blades can be urged into the slits to expand the slits and thereby result in a wiping action against the blades in effecting a connection.

3 Claims, 4 Drawing Figures

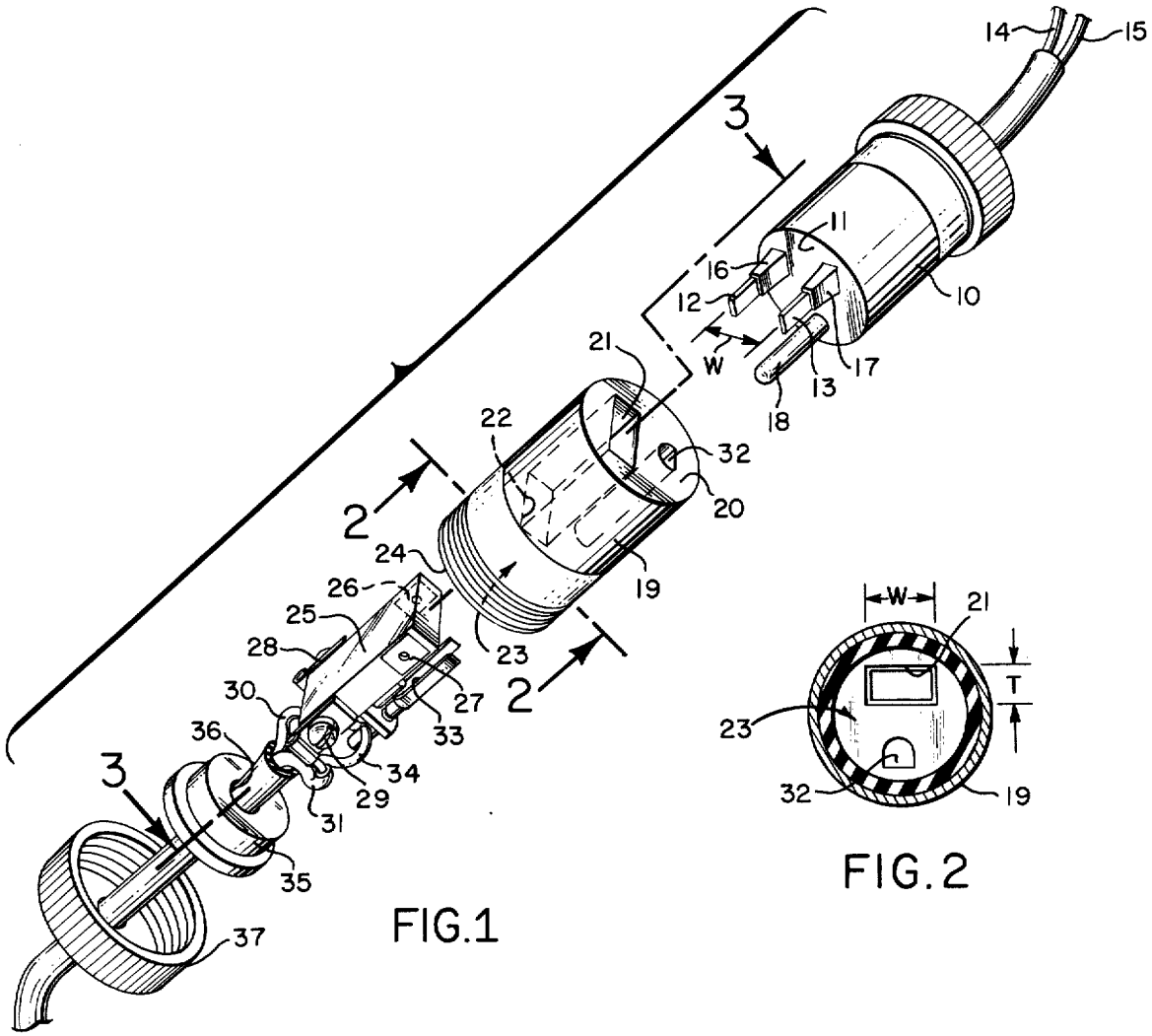
FIG.1
FIG.2
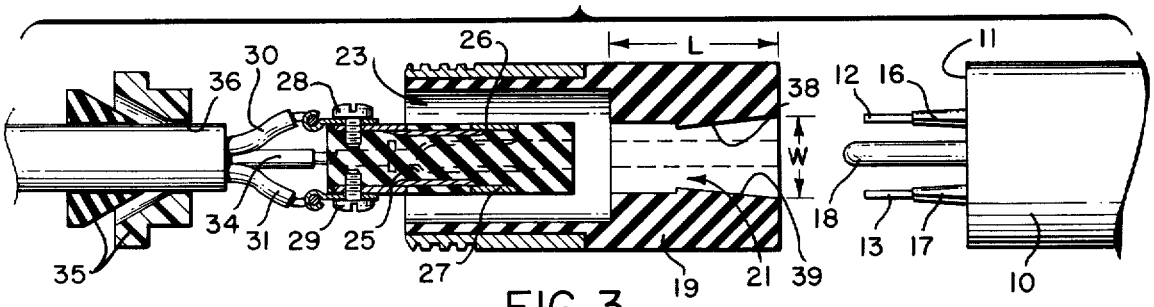
FIG.3
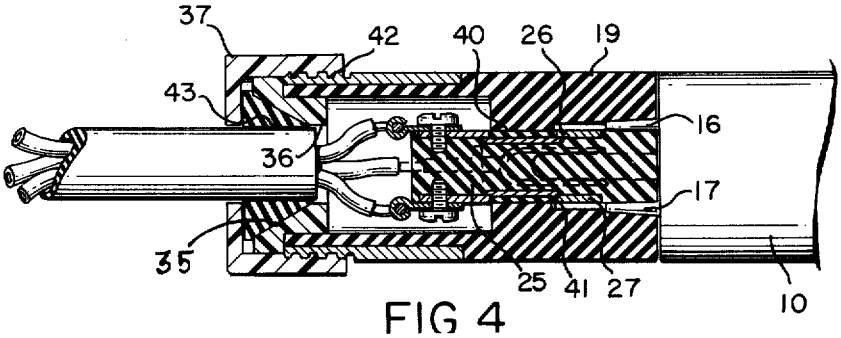
FIG 4

WATERPROOF CONNECTOR

This invention relates to electrical connectors and more particularly to an improved waterproof connector for electrical wires.

BACKGROUND OF THE INVENTION

Many different types of waterproof connectors are known in the art. A desirable feature in such connectors is to assure that no metallic contacts in the socket portion are exposed when the plug portion is disconnected. Towards this end, devices have been proposed including a slidable element which can be caused to eclipse the slot openings for receiving the normal plug prongs after the plug has been disconnected. Other devices include a socket body made of extremely resilient material having openings which must be wedged apart by the plug blades when effecting an electrical connection. When the plug is removed, the walls of the slots collapse back together again which thereby protects the inner connectors from the environment. The integrity of a socket body of this type, however, becomes impaired after extended use, the slot openings tending to become worn so that they do not always close down completely when the plug blades are removed.

Still other types of waterproof connectors comprised of a plug and socket assembly constitute completely molded members. One problem with these later type of devices is the fact that should a wire break internally of the molded structures, the entire assembly is rendered useless.

In any type of plug and socket assembly, it is desirable to provide some means of wiping the plug blades when they are inserted prior to electrical contact with the socket body wires in order to free them from any water or moisture.

BRIEF DESCRIPTION OF THE PRESENT INVENTION

With the foregoing considerations in mind, the present invention contemplates an improved waterproof plug and socket assembly for effecting electrical connections between electrical wires.

More particularly, in accord with the invention, there is provided a plug body having first and second conductive blades extending from its front face. A socket body in turn is provided with a cut-out channel opening out on its front face. A contact supporting member of cross sectional dimensions corresponding to that of the channel is positioned in the channel to fill the same with its forward end terminating in coplanar relationship with the front face of the socket body so that two slits are defined between the outer opposite sides of the member and the inner opposite walls of the channel for receiving, respectively, the first and second blades. The socket body itself is of a resilient material so that the slits can expand to receive the blades in a wiping action.

The contact supporting member itself carries first and second flat metallic contacts on its opposite side walls which are positioned to be engaged by the plug blades after insertion.

In accord with a specific feature of the invention, the opposed channel side walls are tapered inwardly slightly at the entrance portion of the socket body to assure a complete wiping action of the blades when they are inserted. A further feature contemplates the provision of insulative skirts surrounding the base portion of the plug blades which wedge into the slits of the socket to assure a seal after the plug and socket bodies have been connected together.

BRIEF DESCRIPTION OF THE DRAWINGS

A better understanding of the invention will be had by referring to a preferred embodiment thereof as illustrated in the accompanying drawings in which:

FIG. 1 is an exploded perspective view of the basic components making up the waterproof connector of this invention;

FIG. 2 is a cross section of one of the components taken in the direction of the arrows 2—2 of FIG. 1;

FIG. 3 is another exploded view, partly in cross section looking in the direction of the arrows 3—3 of FIG. 1; and, FIG. 4 is a cross section similar to FIG. 3 showing the components in assembled connected relationship.

DETAILED DESCRIPTION OF THE PREFERRED EMBODIMENT

Referring first to FIG. 1 there is shown in the upper right-hand portion of the drawing an insulative plug body 10 having a flat front face 11 from which extend first and second conductive blades 12 and 13. These blades connect internally of the plug body 10 to electrical wires such as indicated at 14 and 15 extending from the opposite end of the body.

In the preferred embodiment illustrated in the drawings each of the blades 12 and 13 is provided with an insulative skirt portion indicated at 16 and 17 extending from the front face 11 and tapering towards a smaller size to terminate about mid-way of the length of the blades. Also shown in the specific embodiment illustrated is a ground prong 18 extending from the front face 11.

The cooperating socket body is shown at 19 and is preferably formed of resilient material. This body has a flat front face 20 and includes a channel 21 of rectangular cross section opening out on the front face. As indicated by the dashed lines, this channel extends into the socket body a given length to terminate within the body as at 22. The remaining portion of the body defines an interior hollow chamber 23 opening out at the opposite end of the body as at 24. As will become clearer with respect to the other views, the cross sectional dimensions of the hollow chamber 23 are greater than that of the channel 21.

Cooperating with the socket body 19 is an electrical contact supporting member 25 also made up of resilient material having a rectangular cross section corresponding to that of the channel and a length greater than the length of the channel so that it can be force-fitted in the channel with the front end of the supporting member 25 coplanar with the front face of the insulative socket body. When so assembled, a rear portion of this member protrudes into the hollow chamber 23 all as will become clearer as the description proceeds.

As shown, the member 25 serves to support electrical contact surfaces 26 and 27 embedded in opposite forward side portions of the member. These electrical contact surfaces internally connect to suitable terminals 28 and 29 on rear opposite side portions of the member 25. Electrical wire leads 30 and 31 connect to the terminals 28 and 29 as shown.

Where a grounding prong is provided on the plug body 10 as shown in FIG. 1, the cooperating socket body 19 is provided with a bore 32 beneath the channel 21 positioned to receive this ground prong. Electrical connection to the ground prong in turn is effected by a metal sleeve 33 supported on the bottom portion of the rectangular member 25, this sleeve being connected as by wire 34 to a suitable ground connection.

The socket assembly is completed by the provision of an insert 35 having a central opening 36 through which the various leads can extend out the opposite end of the body. A collar 37 is arranged to close off the end 24 of the socket body 19 when the various parts are assembled.

Referring now to FIG. 2, it will be noted that the rectangular channel 21 has a given width W and a given thickness T. The width W corresponds to the distance between the first and second conductive blades 12 and 13 from the plug 10 as described in FIG. 1 and the dimension T corresponds to the distance between the top and bottom surfaces of the blades 12 and 13.

In FIG. 2, the larger cross sectional dimensions of the hollow chamber 23 which in the embodiment shown is circular can be seen to be greater than the cross sectional dimension of the rectangular channel 21.

Referring now to FIG. 3, further details and features of the invention will be evident. Thus, the connection of the electrical contacts 26 and 27 with the terminals 28 and 29 through internal conductors is clearly shown. In addition, it will be noted that the opposite inside forward walls of the channel 21 are initially tapered inwardly slightly as indicated at 38 and 39. Also, the overall length of the contact support member 25 is sufficiently greater than the length L of the channel 21 that when the member 25 is positioned within the channel, the terminals 28 and 29 fall within the larger hollow chamber 23. In FIG. 3, it should be understood that the same numerals utilized in FIG. 1 designate corresponding components.

FIG. 4 illustrates the components in completely assembled relationship with the plug body 10 connected to the socket body 19. In this position, it will be evident that with the member 25 positioned within the channel 21, slits are defined between the outer side walls of the member 25 and the inner side walls of the channel as indicated at 40 and 41. Thus, there is required a somewhat forced entry of the blades 12 and 13 of the plug body 10 into the entrance portion of these slits. Because the socket body 19 is of resilient material and if desired the member 25 may be made of similar resilient material, the slits can "give" to receive the blades 12 and 13. The spreading of the slits by the blades results in a wiping action of the blades which removes any water or moisture on the blades.

With respect to the foregoing, the provision of the inward tapers 38 and 39 described in FIG. 3 in the opposite channel walls enhances this wiping action of the blades 12 and 13.

It will also be evident from FIG. 4 that when the plug body and socket body are in complete engagement, the tapered skirts 16 and 17 on the blades wedge into the entrance of the slits 40 and 41 to thereby provide an excellent seal. It will be clear from FIG. 4 that in the completely connected position, the blades are in electrical engagement with the contacts 26 and 27 supported on the member 25.

As described briefly heretofore, the rear portion of the socket body 19 includes external threads cooperating with internal threads as indicated at 42 on the collar 37. This collar serves to exert pressure on the insert 36 which closes off the opening of the chamber of the socket body opposite its front face. The pressure exerted by the collar expands the insert to effect a very tight seal about the wires as indicated at 43 and also against the rear opening of the chamber in the socket body 19. With this arrangement, it will be evident that moisture and water are properly excluded from this chamber portion housing the terminals and yet by unthreading the collar 37, ready access is had to the terminals.

Because the contact support member 25 is a separate component which, as stated, may be resilient, it cooperates with the opposite side walls of the channel in the manner to provide a squeezing force on the blades of the plug when urged therebetween over a longer period of time than would result were simple openings formed in the socket body itself. In other words, the member 25 is free to expand after being compressed by the blades of the plug since it is not integrally connected to the floor and ceiling or side walls of the channel 21 in the socket body. This feature together with forming the entrance tapers 38 and 39 in the socket body itself assures that the slits are closed off when the plug is separated and that a reliable wiping action occurs when the plug is inserted. Moreover, the female socket body is waterproof when unplugged as a consequence of the closing off of the slits by the tapers.

It will be understood from the dotted lines showing in FIG. 4 that the ground prong 18 is received in the bore 32 as the blades 12 and 13 are urged into the channel 21 in a manner to straddle the member 25. Sleeve 33 is received in the inner end of the bore 32 so that it is engaged by the ground prong 18 when the connection is completed.

From the foregoing description, it will be seen that the present invention has provided a greatly improved waterproof connector.

What is claimed is:

1. A waterproof connector for electrical wires comprising, in combination;

a. an insulative plug body having first and second conductive blades extending from a front face thereof and separated by a given distance, each of said blades having an insulated skirt portion about its base at the point it exits from said front face, said skirt tapering towards a smaller size as it extends from the surface to terminate approximately at a mid-point of the blade, the inner ends of the blades within the plug body connecting to electrical wires passing from an opposite end of said plug body;

b. an insulative socket body of resilient material having a channel of rectangular cross section opening out at a front face and extending into said socket body a given length to terminate within said body, the remaining portion of said body defining an interior hollow chamber opening out at an opposite end of the body of greater cross sectional dimensions than said channel;

c. an electrical contact supporting member of resilient material having a rectangular cross section corresponding to that of said channel and a length greater than the length of the channel so that it can be force-fitted in said channel with the front end of said supporting member coplanar with the front face of said insulative socket body and a rear portion of said member protruding into said hollow chamber; and d. electrical contact surfaces embedded in opposite forward sides of said member and internally connecting to terminals in opposite rear sides of said member for receiving electrical leads passing into said opposite end of said body, the width of the channel corresponding to said given distance between the conductive blades of said plug and the forward opposite inner walls of said channel being tapered inwardly slightly, whereby said blades can be urged into said channel to straddle opposite sides of said member, the resilient material of the insulative socket body and member together with the tapering inwardly of the channel walls exerting a squeezing action on the blades to wipe them clean of water and moisture, said skirts on the blades plugging the channel entrance sides to effect a waterproof connection.

2. A connector according to claim 1, including an insert received in said opposite end opening of the chamber in said insulative body, said insert having a central opening through which said electrical leads pass, the rear portion of said insulative body having external threads; and a threaded collar receivable on said external threads for exerting a squeezing force on said insert to cause it to effect a water-tight seal around said electrical leads and the entrance portion of the hollow chamber at the opposite end of said insulative body.

3. A connector according to claim 1, in which said plug body includes a ground prong extending from its front face, said insulative body including a bore beneath said channel for receiving said ground prong; and connector means secured to the underside of said member for effecting a ground connection to said ground prong when said plug body and socket body are connected together.

* * * * *